US011434667B2

(12) United States Patent
Restivo, II

(10) Patent No.: US 11,434,667 B2
(45) Date of Patent: Sep. 6, 2022

(54) ADAPTER COLLECTION RING STRUCTURE

(71) Applicants: Simply45, LLC, Fort Lauderdale, FL (US); Elka International Ltd, New Taipei (TW)

(72) Inventor: Andrew Vincent Restivo, II, Fort Lauderdale, FL (US)

(73) Assignees: SIMPLY45, LLC, Fort Lauderdale, FL (US); ELKA INTERNATIONAL LTD, New Taipei (TW)

( * ) Notice: Subject to any disclaimer, the term of this patent is extended or adjusted under 35 U.S.C. 154(b) by 583 days.

(21) Appl. No.: 16/533,515

(22) Filed: Aug. 6, 2019

(65) Prior Publication Data

US 2021/0040777 A1 Feb. 11, 2021

(51) Int. Cl.

| | |
|---|---|
| ***H01R 25/00*** | (2006.01) |
| ***E05B 73/00*** | (2006.01) |
| ***H01R 13/518*** | (2006.01) |
| ***H01R 31/06*** | (2006.01) |

(52) U.S. Cl.

CPC ..... *E05B 73/0005* (2013.01); *H01R 13/518* (2013.01); *H01R 31/06* (2013.01)

(58) Field of Classification Search

CPC ..... H01R 13/518; H01R 31/06; H01R 27/00; H01R 24/54; E05B 73/0005; E05B 67/00; E05B 71/00; E05B 73/00

See application file for complete search history.

(56) References Cited

U.S. PATENT DOCUMENTS

| | | | | |
|---|---|---|---|---|
| 4,004,440 | A * | 1/1977 | Dreyer | E05B 73/0005 70/58 |
| 4,325,238 | A * | 4/1982 | Scherbing | E05B 67/003 70/49 |
| 4,570,465 | A * | 2/1986 | Bennett | E05B 73/0005 70/371 |
| 5,412,959 | A * | 5/1995 | Bentley | E05B 67/003 42/70.11 |
| 6,430,973 | B1 * | 8/2002 | Huang | E05B 67/003 70/49 |
| 7,576,981 | B2 * | 8/2009 | Kuo | G06F 1/1679 361/679.57 |
| 8,056,377 | B2 * | 11/2011 | Hacker | E05G 1/005 70/30 |
| 8,176,615 | B2 * | 5/2012 | Konecnik | E05B 73/0082 70/58 |

(Continued)

*Primary Examiner* — Thanh Tam T Le

(74) *Attorney, Agent, or Firm* — Chun-Ming Shih; HDLS IPR Services

(57) ABSTRACT

An adapter collection ring structure, that includes: a plurality of adapters, used to be connected to connectors of various different specifications; a ring shape lock piece, formed by a flexible wire bodies having both ends disposed a lock head and a lock insertion rod respectively; a plurality of plug sleeve piece, each having a fix end and a movable end, with the fix end connected to a wire body of the ring lock piece, and with its movable end connected to a connection portion, connected to the plurality of adapters respectively. The adapter collection ring structure can be used to gather and protect a plurality of adapters connected to the ring shape lock piece, so that the range of movement of the adapters is limited by the length of the plug sleeve piece, to protect the adapters from being opened and taken away easily.

6 Claims, 7 Drawing Sheets

(56) References Cited

U.S. PATENT DOCUMENTS

| | | | | |
|---|---|---|---|---|
| 9,402,453 | B2 * | 8/2016 | Yan | B67B 7/16 |
| 9,650,813 | B2 * | 5/2017 | Liu | E05B 73/0082 |
| 9,784,338 | B1 * | 10/2017 | Parrett | H01R 31/06 |
| 9,816,296 | B2 * | 11/2017 | Denny | E05B 37/02 |
| 9,963,915 | B1 * | 5/2018 | Earle | E05B 73/0005 |
| 10,329,804 | B2 * | 6/2019 | Evans | E05B 73/0005 |
| 10,404,004 | B2 * | 9/2019 | Fuda | H01R 13/44 |
| 10,463,128 | B1 * | 11/2019 | Kaspian | G10G 7/005 |
| 10,554,001 | B1 * | 2/2020 | Criswell | H04R 3/00 |
| 11,158,985 | B1 * | 10/2021 | Sumida | H04N 21/43635 |
| 11,264,761 | B2 * | 3/2022 | Hedrick | H01R 24/58 |

* cited by examiner

ADAPTER COLLECTION RING STRUCTURE

BACKGROUND OF THE INVENTION

Field of the Invention

The present invention relates to a structure used for an adapter, and in particular to an adapter collection ring structure.

The Prior Arts

Nowadays, due to the widespread and increasing use of Internet, people usually use 3C products, such as smart phones, tablets, notebook computers, and other types of handsets to send and receive e-mail and to gather information easily and conveniently. As such, the 3C products play an important role in our daily life. In this respect, the price of new generation of 3C product tends to be high, and since it is of light weight and compact size, it is liable to be stolen and taken away easily in an Exhibition. Therefore, presently on the market, quite a lot of anti-theft locks and chains are available, to prevent 3C products from being stolen.

In addition, a lot of high-end connectors and adapters are available on the market and are often placed in an Exhibition for display and sales promotion. Due to the enormous crowd on sight, the connectors and adapters can be stolen and taken away easily, to cause losses and damages to the vendors. Even worse, this may cause supply shortage of 3C products, to adversely affect the normal operations of an Exhibition.

For the conventional anti-theft connector head, on an adapter is provided with a hole, for a ring-shape rope body to penetrate through. And a fastening sleeve tube is disposed on the rope body, to be fixed onto a fix position of the adapter, to restrict the adapter connected to move only in a range of the length of the ring-shape rope body, to prevent theft from happening. However, this type of structure is rather too simple, the anti-theft function is not sufficient, thus the adapter can easily be broken, to cause damage and loss to its user.

Therefore, presently, the design and performance of the anti-theft connector head is not quite satisfactory, and it leaves much room for improvements.

SUMMARY OF THE INVENTION

In view of the problems and drawbacks of the prior art, the present invention provides an adapter collection ring structure, that is novel in design, and easy to operate.

The present invention provides an adapter collection ring structure, that includes: a plurality of adapters, a ring shape lock piece, and a plurality of plug sleeve pieces. The plurality of adapters is used to be connected to connectors of various different specifications. The ring shape lock piece is formed by a flexible wire bodies having both ends disposed a lock head and a lock insertion rod respectively. The plurality of plug sleeve piece is adapted to each having a fixed end and a movable end, with the fixed end connected to a wire body of the ring lock piece, and with its movable end connected to a connection portion, connected to the plurality of adapters 1 respectively.

Preferably, the lock head is one of a combination lock and a key lock but the present invention is not limited to this.

Preferably, the plug sleeve piece is a flexible short section wire body, with a sleeve ring, disposed at a tail portion of the fixed end of the plug sleeve piece, but the present invention is not limited to this.

Preferably, the ring shape lock piece and the plug sleeve piece are made of steel wires, but the present invention is not limited to this.

Compared with the existing technology, the present invention has the advantages that, it can be used to gather and protect a plurality of adapters connected to the ring shape lock piece, so that the range of movement of the adapters is limited by the length of the plug sleeve piece. In this way, the present invention is able to protect the adapters from being lost, to prevent the adapter collection ring structure from being opened, and the adapters being taken away easily, in achieving the objective of preventing the loss or theft of the adapters.

In addition, through the design of the present invention, a plurality of various independent adapters can be attached to the same connection cable. As such, the adapters can be replaced by various other types of adapters at any time. When the adapter is inserted and connected by the connector head connected to the connection cable, it could satisfy the needs of the various 3C products. The outputs of the adapters can be connected to the peripheral equipment of the prevalent technology, such as liquid crystal screen, projector, stereo surround sound device, or other various devices.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

In the following, an embodiment is used to describe the various details of the present invention. However, it does not mean that this embodiment represents all the embodiments of the present invention. Other embodiments can be envisaged by people familiar with this field, and thus they all fall into the scope of the present invention.

Figure 1:
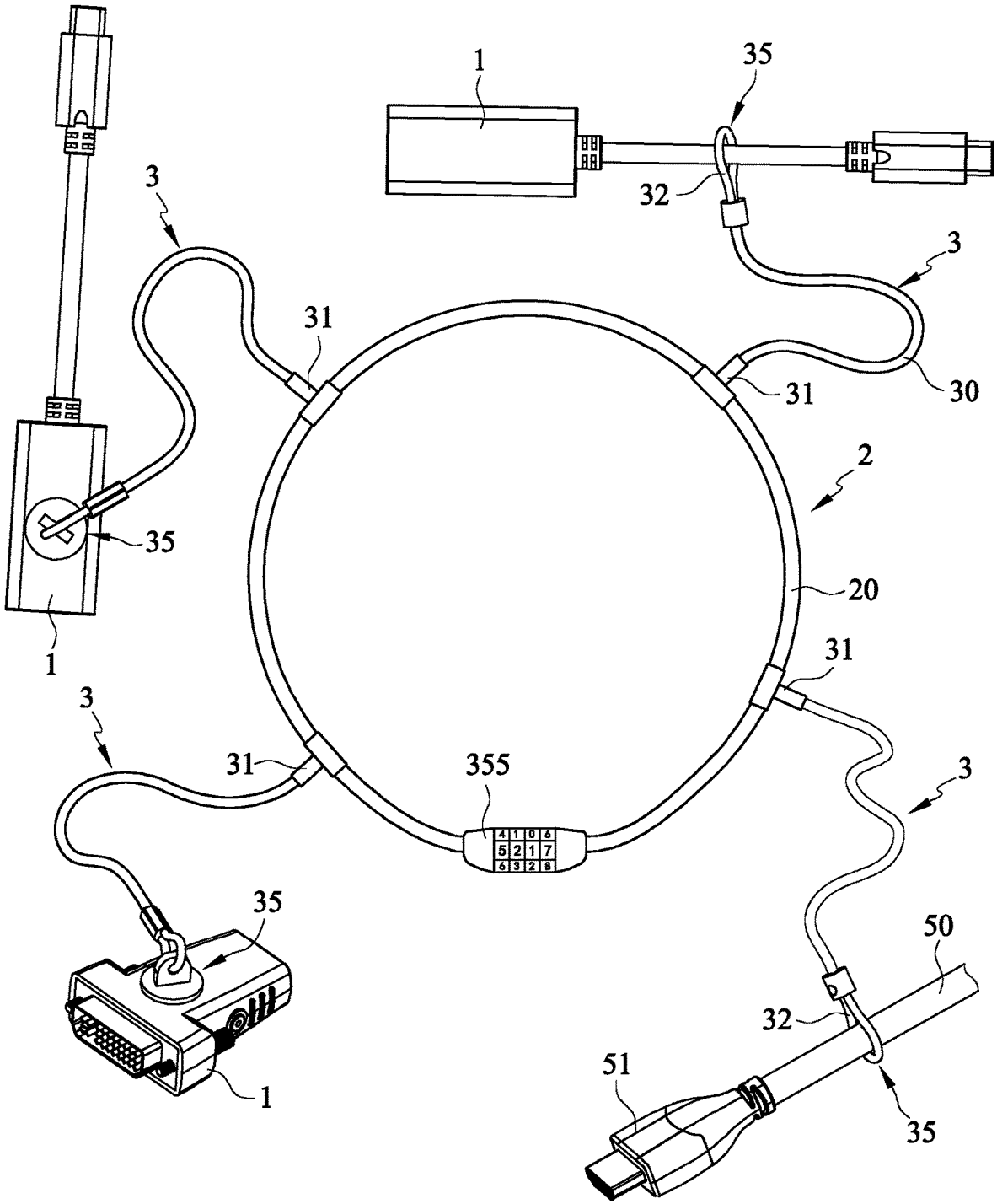
FIG. 1 is a schematic diagram of the adapter collection ring structure in application according to the first embodiment of the present invention.
Figure 2:
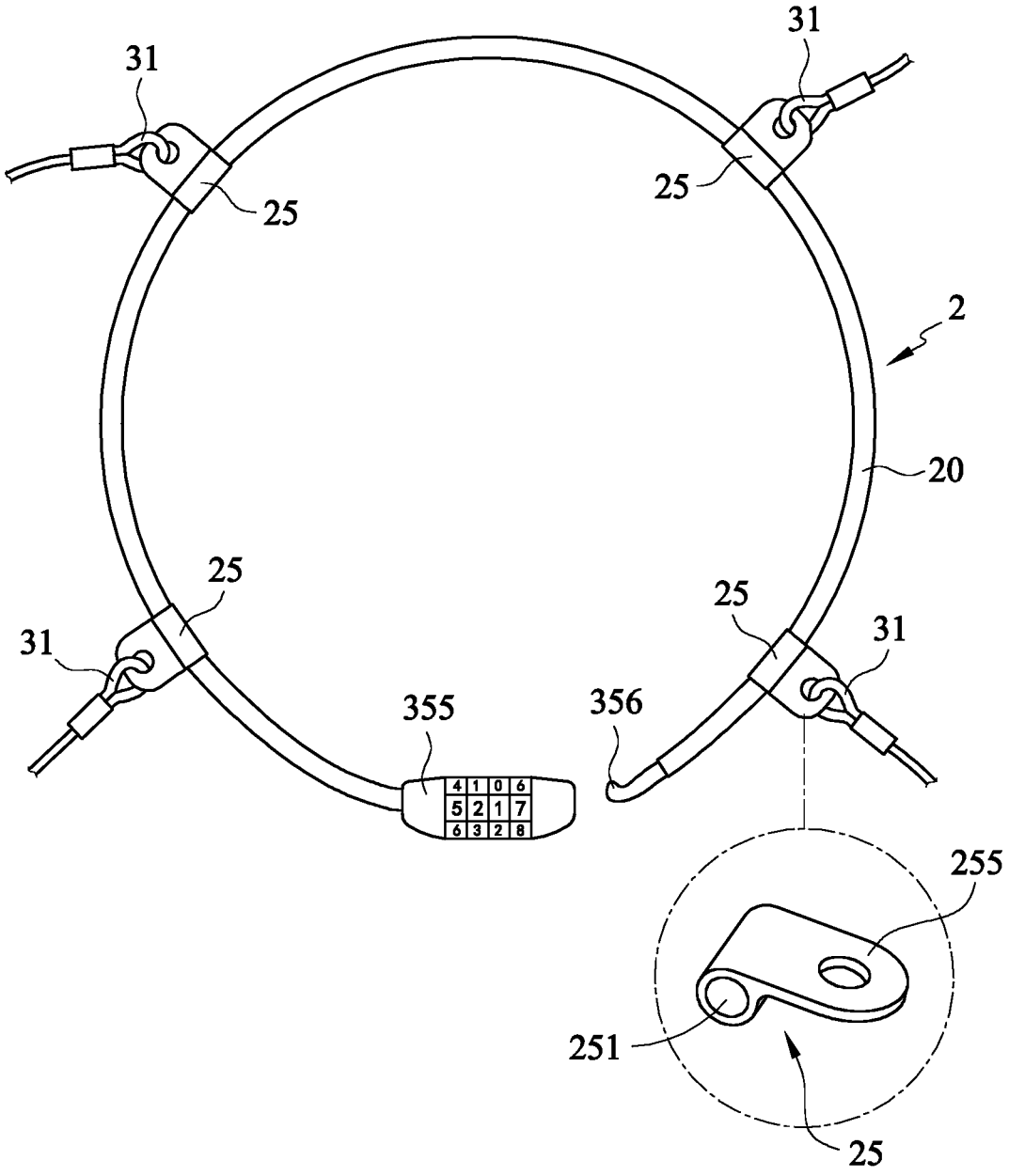
FIG. 2 is a schematic diagram of the ring shape lock piece according to the present invention.
Figure 3:
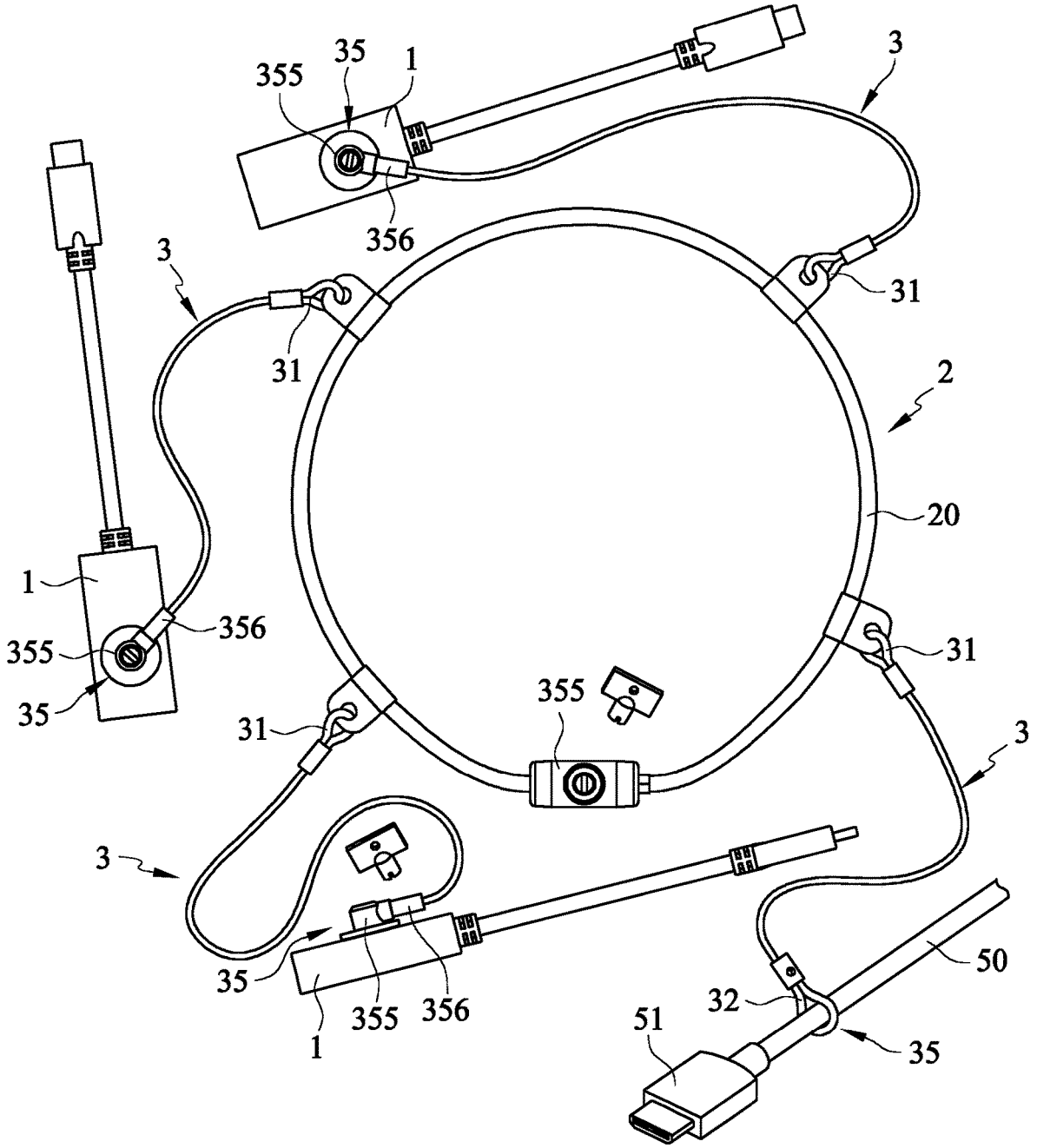
FIG. 3 is a schematic diagram of an adapter collection ring structure according to the second embodiment of the present invention.

Refer to FIGS. 1 to 3 respectively for a schematic diagram of the adapter collection ring structure in application according to the first embodiment of the present invention; a schematic diagram of the ring shape lock piece according to the present invention; and a schematic diagram of an adapter collection ring structure according to the second embodiment of the present invention. As shown in FIGS. 1-3, The present invention provides an adapter collection ring structure, that includes: a plurality of adapters 1, a ring shape lock piece 2, and a plurality of plug sleeve piece 3. The plurality of adapters 1 is used to connected to connectors of various different specifications. The ring shape lock piece 2 is formed by a flexible wire bodies having both ends disposed a lock head 355 and a lock insertion rod 356 respectively. The plurality of plug sleeve piece 3 is adapted to each having a fix end and a movable end, with the fix end connected to a wire body 20 of the ring lock piece 2, and with its movable end connected to a connection portion 35, connected to the plurality of adapters 1 respectively.

Preferably, the lock head 355 is one of a combination lock (as shown in FIG. 1) and a key lock (as shown in FIG. 3), but the present invention is not limited to this.

Preferably, the plug sleeve piece 3 is a flexible short section wire body 30, with a sleeve ring 31, disposed at a tail portion of the fixed end of the plug sleeve piece 3, but the present invention is not limited to this.

Preferably, the ring shape lock piece 2 and the plug sleeve piece 3 are made of steel wires, but the present invention is not limited to this.

Preferably, as shown in FIGS. 1 and 2, a plurality of connection hole seats 25 are disposed around and spaced equally apart along the ring shape lock piece 2. Each of connection hole seats 25 is provided with a hole sleeve body 251, and a plate having a hole 357 is connected to the hole sleeve body 251. The hole sleeve body 251 is for the ring shape lock piece 2 to run through, and the plate having the hole 357 is for the sleeve ring 31 at the fixed end of the plug sleeve piece 3 to run through a hole in the plate having the hole 357.

Preferably, as shown in FIGS. 3 to 6, a second sleeve ring 32 is disposed at the movable end of the plug sleeve piece 3, and the connection portion 35 is formed by the second sleeve ring 32 at the movable end of the plug sleeve piece 3, to circle around the connection cable 50 of a fixed rod (not shown).

Figures 4, 4A:
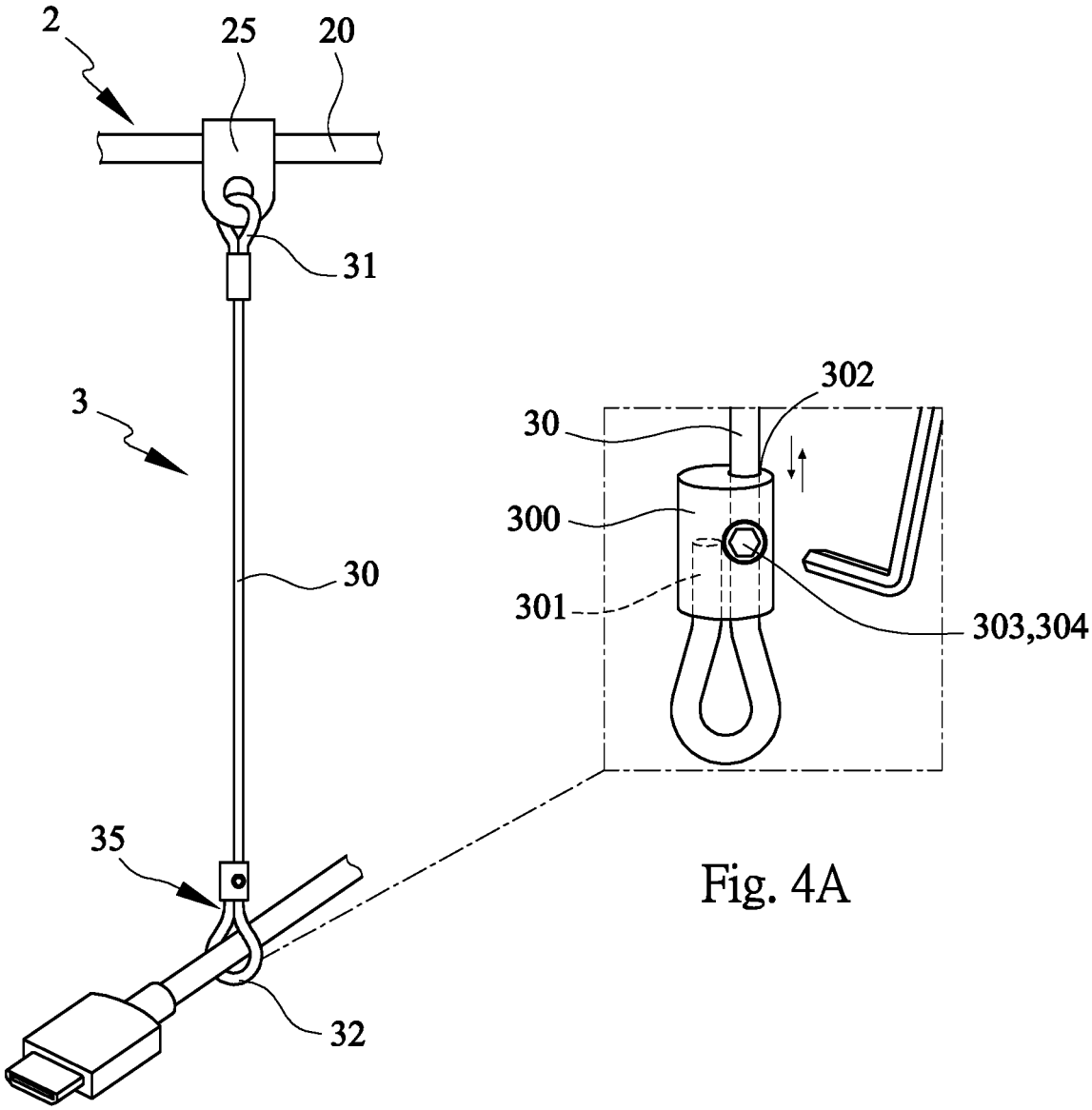
FIGS. 4 and 4A are schematic diagrams of the plug sleeve piece of the first type according to the present invention.

Preferably, as shown in FIG. 4A, a position adjusting piece 300 is disposed on the second ring 32 at the movable end of the plug sleeve piece 3, a blind hole 301 and a perforation hole 302 are disposed on the position adjusting piece 300, the perforation hole 302 is for the plug sleeve piece 3 to run through, and with the movable end of the plug sleeve piece 3 bent and fixed in the blind hole 301, and on a side of the perforation hole 302 is disposed a screw hole 303 and a screw 304. Preferably, the screw 304 can be an ordinary screw or a special screw.

Figures 5, 5A:
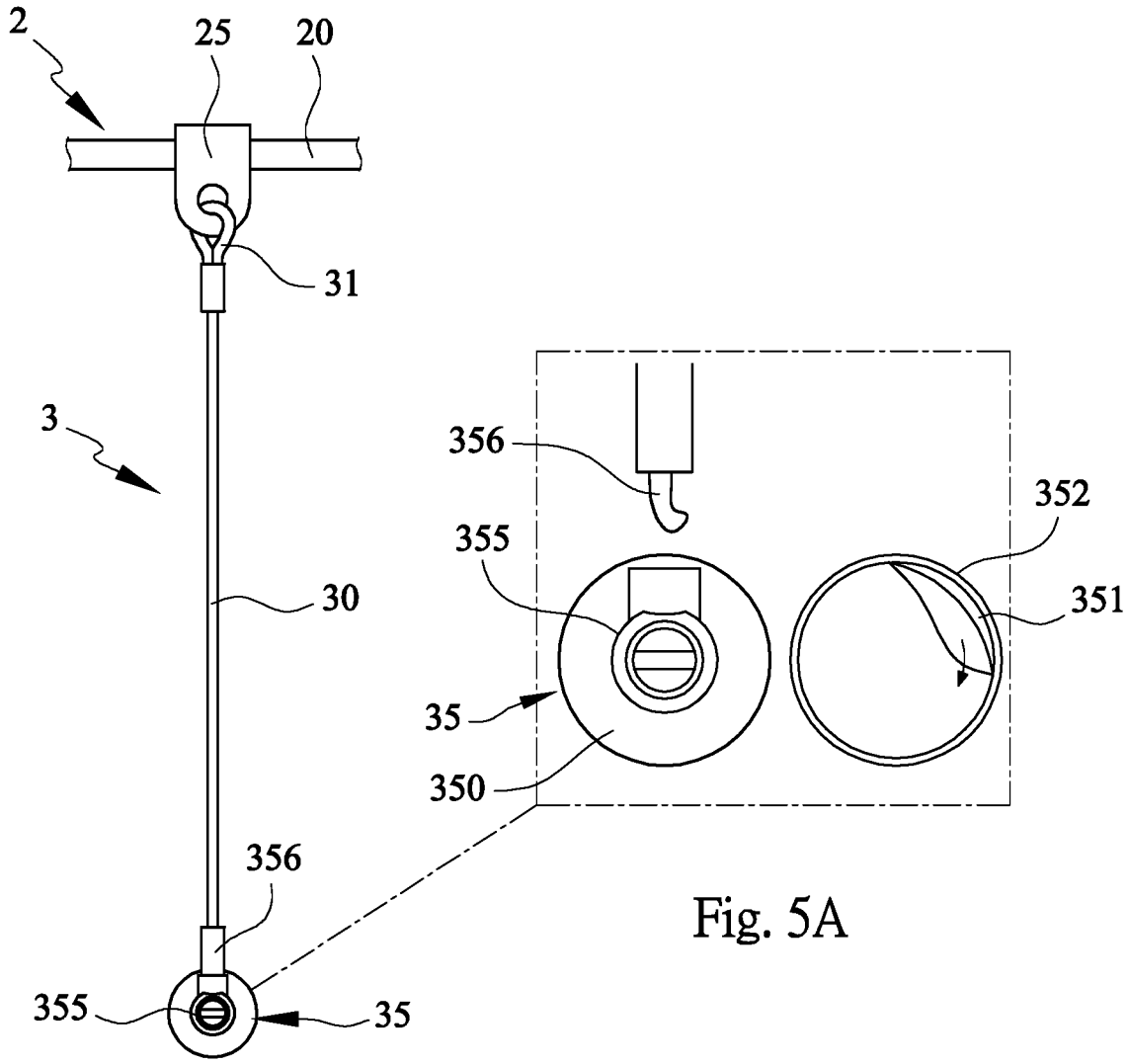
FIGS. 5 and 5A are schematic diagrams of the plug sleeve piece of the second type according to the present invention.
Figures 6, 6A:
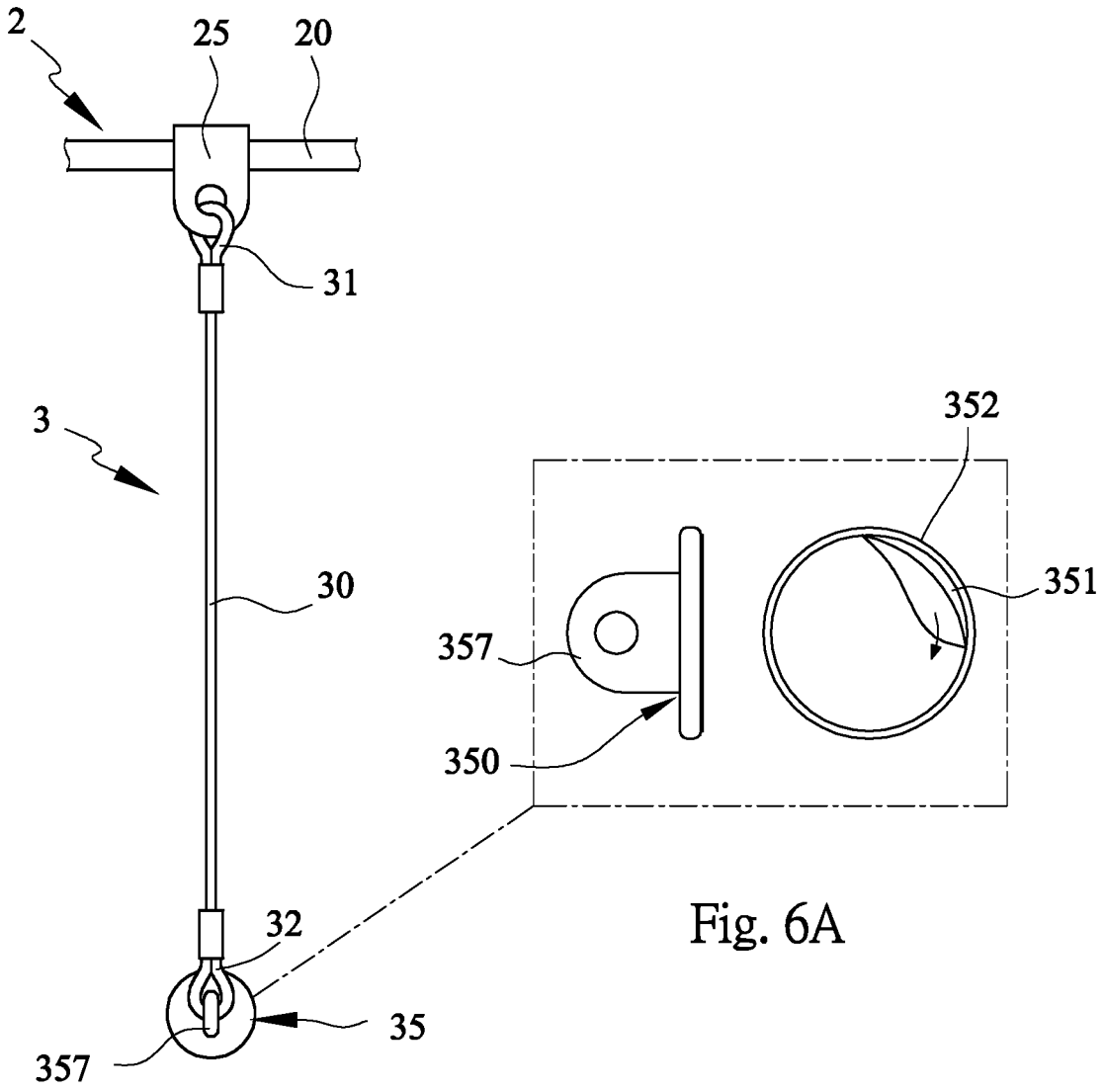
FIGS. 6 and 6A are schematic diagrams of the plug sleeve piece of the third type according to the present invention.

Preferably, as shown in FIGS. 5A, 6A, the adapter collection ring structure further includes a connection portion 35 formed by an adhesion seat 350, and a round plate 352 of the double-faced adhesion tape 351 at a bottom portion of the adhesion seat 350.

Preferably, as shown in FIG. 5A, a lock head 355 is disposed on an upper surface of the adhesion seat 350, and a lock insertion rod 356 is disposed at the movable end of the plug sleeve piece 3.

Preferably, as shown in FIG. 6A, the plate having the hole 357 is disposed on an upper side of the adhesion seat 350, for the second sleeve ring 32 at the movable end of the plug sleeve piece 3 to run through and hook the plate having the hole 357.

Through the design of placing the round plate 352 of the double-faced adhesion tape 351 at a bottom portion of the adhesion seat 350 of the connection portion 35, the connection portion 35 can be adhered and attached conveniently to the outer shells of various different adapters 1. In this way, a plurality of adapters can be attached onto the ring shape lock piece 2 dynamically, so that the user may utilize the adapters 1 of different types according to his choice and preference.

Figure 7:
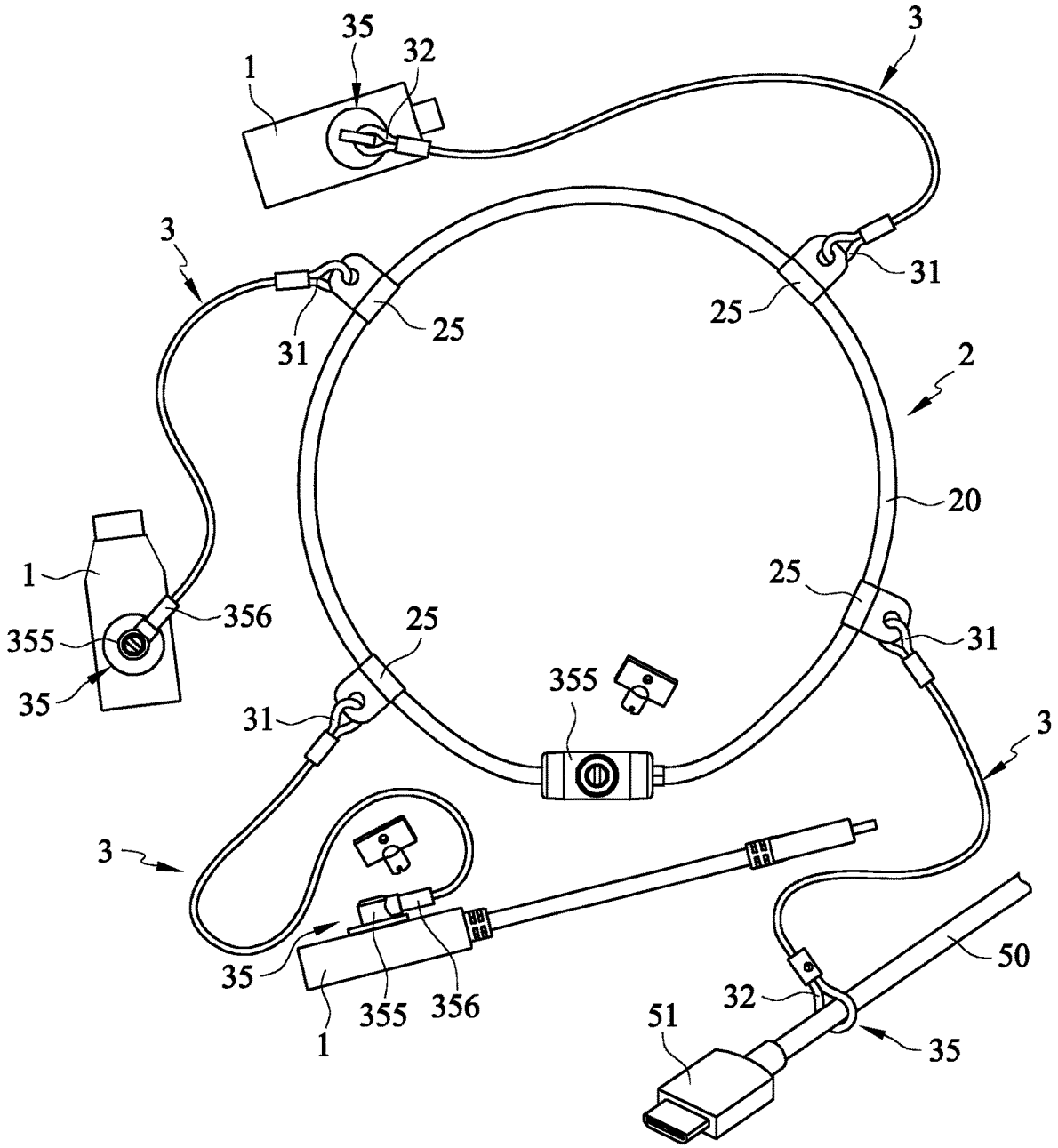
FIG. 7 is a schematic diagram of the adapter collection ring structure in application according to the third embodiment of the present invention.

Preferably, as shown in FIGS. 1 and 3, The same type plug sleeve pieces 3 can be attached and connected onto a ring shape lock piece 2. Or, alternatively, as shown in FIG. 7, different type plug sleeve pieces 3 can be attached and connected in combination onto a ring shape lock piece 2.

Compared with the existing technology, the present invention has the advantages in that, it can be used to gather and protect the plurality of various types of adapters 1 connected to the ring shape lock piece 2, so that the range of movement of the adapters 1 is limited by the length of the plug sleeve piece 3. In this way, the present invention is able to protect the adapter from being lost, to prevent the ring shape lock piece 2 from being opened and the adapters 1 being taken away easily, in achieving the objective of preventing the loss or theft of the adapters 1.

In addition, through the design of the present invention, a plurality of various independent adapters 1 can be attached to the same connection cable 50 to be sold conveniently. As such, as shown in FIG. 7, the user is allowed to utilize the adapters 1 of different types according to his choice and preference, so that the adapters 1 can be replaced by various types of other adapters 1 at any time. When the adapter 1 is inserted and connected by the connector head 51 connected to the connection cable 50, it could satisfy the needs of the various 3C products. The output of the adapters 1 can be connected to the peripheral equipment of the prevalent technology, such as liquid crystal screen, projector, and stereo surround sound device.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. An adapter collection ring structure, comprising:

a plurality of adapters, used to be connected to connectors of various different specifications;

a ring shape lock piece, formed by a flexible wire body having both ends disposed a lock head and a lock insertion rod respectively; and a plurality of plug sleeve pieces, each having a fixed end and a movable end, with the fixed end connected to the ring shape lock piece, and with the movable end connected to a connection portion, connected to the plurality of adapters respectively, wherein the plug sleeve piece is a flexible short section wire body, with a first sleeve ring disposed at a tail portion of the fixed end of the plug sleeve piece;

wherein the ring shape lock piece and the plug sleeve piece are made of steel wire;

wherein a plurality of connection hole seats are disposed around and spaced equally apart along the ring shape lock piece; each of connection hole seats is provided with a hole sleeve body, and a plate having a hole is connected to the hole sleeve body; the hole sleeve body is for the ring shape lock piece to run through, and the plate having the hole is for the first sleeve ring at the fixed end of the plug sleeve piece to run through a hole in the plate having the hole;

wherein a second sleeve ring is disposed at the movable end of the plug sleeve piece, and the connection portion is formed by the second sleeve ring at the movable end of the plug sleeve piece.

2. The adapter collection ring structure as claimed in claim 1, wherein the lock head is one of a combination lock and a key lock.

3. An adapter collection ring structure, comprising:

a plurality of adapters, used to be connected to connectors of various different specifications;

a ring shape lock piece, formed by a flexible wire body having both ends disposed a lock head and a lock insertion rod respectively;

a plurality of plug sleeve pieces, each having a fixed end and a movable end, with the fixed end connected to the ring lock piece, and with the movable end connected to a connection portion, connected to the plurality of adapters respectively; and a connection portion formed by an adhesion seat, and a round plate of double-faced adhesion tape at a bottom portion of the adhesion seat, wherein the plug sleeve piece is a flexible short section wire body, with a first sleeve ring disposed at a tail portion of the fixed end of the plug sleeve piece;

wherein the ring shape lock piece and the plug sleeve piece are made of steel wire;

wherein a plurality of connection hole seats are disposed around and spaced equally apart along the ring shape lock piece; each of connection hole seats is provided with a hole sleeve body, and a plate having a hole is connected to the hole sleeve body; the hole sleeve body is for the ring shape lock piece to run through, and the plate having the hole is for the first sleeve ring at the fixed end of the plug sleeve piece to run through a hole in the plate having the hole.

4. The adapter collection ring structure as claimed in claim 3, wherein the lock head is disposed on an upper surface of the adhesion seat, and the lock insertion rod is disposed at the movable end of the plug sleeve piece.

5. The adapter collection ring structure as claimed in claim 3, wherein a second sleeve ring is disposed at the movable end of the plug sleeve piece, and the plate having the hole is disposed on an upper side of the adhesion seat, for the second sleeve ring at the movable end of the plug sleeve piece to run through to hook the plate having the hole.

6. The adapter collection ring structure as claimed in claim 5, wherein a position adjusting piece is disposed on the second ring at the movable end of the plug sleeve piece, a blind hole and a perforation hole are disposed on the position adjusting piece, the perforation hole is for the plug sleeve piece to run through, and with the movable end of the plug sleeve piece bent and fixed in the blind hole, and on a side of the perforation hole is disposed a screw hole and a screw.

* * * * *